US008240796B2

(12) United States Patent
Von Essen et al.

(10) Patent No.: US 8,240,796 B2
(45) Date of Patent: Aug. 14, 2012

(54) FLUID EJECTOR HOUSING INSERT

(75) Inventors: Kevin Von Essen, San Jose, CA (US); Andreas Bibl, Los Altos, CA (US); John A. Higginson, Santa Clara, CA (US); Steve Deming, San Jose, CA (US); Mats G. Ottosson, Cupertino, CA (US)

(73) Assignee: FUJIFILM Corporation, Tokyo (JP)

( * ) Notice: Subject to any disclaimer, the term of this patent is extended or adjusted under 35 U.S.C. 154(b) by 447 days.

(21) Appl. No.: 12/500,557

(22) Filed: Jul. 9, 2009

(65) Prior Publication Data

US 2011/0006135 A1 Jan. 13, 2011

(51) Int. Cl.
*B41J 29/38* (2006.01)

(52) U.S. Cl. ..... 347/9

(58) Field of Classification Search ..... 239/13, 239/25, 44, 87, 89, 133, 288.5, 300, 414, 239/459, 589, 590, 602, 731, 752; 347/11, 347/29, 37, 40, 44, 47, 49, 54, 61, 62, 85, 347/86, 93

See application file for complete search history.

(56) References Cited

U.S. PATENT DOCUMENTS

| | | | | |
|---|---|---|---|---|
| 6,547,373 | B2 | 4/2003 | Kitahara | |
| 2005/0078143 | A1 * | 4/2005 | Shimomura et al. | 347/20 |
| 2007/0076051 | A1 * | 4/2007 | Fujii et al. | 347/42 |

FOREIGN PATENT DOCUMENTS

| | | |
|---|---|---|
| JP | 9-187930 | 7/1997 |
| JP | 2001-113697 | 4/2001 |

* cited by examiner

*Primary Examiner* — Stephen Meier
*Assistant Examiner* — Alexander C Witkowski
(74) *Attorney, Agent, or Firm* — Fish & Richardson P.C.

(57) ABSTRACT

A fluid ejector includes a fluid ejection assembly, a housing, and an insert. The fluid ejection assembly includes one or more silicon bodies and a plurality of actuators. The one or more silicon bodies includes a silicon body having a plurality of fluid passages for fluid flow and a plurality of nozzles fluidically connected to the plurality of fluid passages. The plurality of actuators cause fluid in the plurality of fluid passages to be ejected from the plurality of nozzles. The housing assembly includes one or more plastic bodies, at least one plastic body attached to at least one silicon body to form a sealed volume on a side of the fluid ejection assembly opposite the nozzles. The insert is embedded in the at least one plastic body in proximity to the at least one silicon body, the insert having a coefficient of thermal expansion of less than 9 ppm/° C.

28 Claims, 5 Drawing Sheets

FLUID EJECTOR HOUSING INSERT

TECHNICAL FIELD

The present disclosure relates generally to fluid droplet ejection.

BACKGROUND

In some implementations of a fluid droplet ejection device, a substrate, such as a silicon substrate, includes a fluid pumping chamber, a descender, and a nozzle formed therein. Fluid droplets can be ejected from the nozzle onto a medium, such as in a printing operation. The nozzle is fluidly connected to the descender, which is fluidly connected to the fluid pumping chamber. The fluid pumping chamber can be actuated by a transducer, such as a thermal or piezoelectric actuator, and when actuated, the fluid pumping chamber can cause ejection of a fluid droplet through the nozzle. The medium can be moved relative to the fluid ejection device. The ejection of a fluid droplet from a nozzle can be timed with the movement of the medium to place a fluid droplet at a desired location on the medium. Fluid ejection devices typically include multiple nozzles, and it is usually desirable to eject fluid droplets of uniform size and speed, and in the same direction, to provide uniform deposition of fluid droplets on the medium.

SUMMARY

In general, in one aspect, a fluid ejector includes a fluid ejection assembly, a housing, and an insert. The fluid ejection assembly includes one or more silicon bodies and a plurality of actuators. The one or more silicon bodies includes a silicon body having a plurality of fluid passages for fluid flow and a plurality of nozzles fluidically connected to the plurality of fluid passages. The plurality of actuators cause fluid in the plurality of fluid passages to be ejected from the plurality of nozzles. The housing assembly includes one or more plastic bodies, at least one plastic body of the one or more plastic bodies sealingly attached to at least one silicon body of the one or more silicon bodies to form a sealed volume on a side of the fluid ejection assembly opposite the nozzles. The insert is embedded in the at least one plastic body in proximity to the at least one silicon body, the insert having a coefficient of thermal expansion (CTE) of less than 9 ppm/° C.

This and other embodiments can optionally include one or more of the following features. The silicon body having a plurality of fluid passages for fluid flow and a plurality of nozzles fluidically connected to the plurality of fluid passages can include a substrate, and the at least one silicon body can include an interposer. The interposer can be a first interposer, and the fluid ejection assembly can further include a second interposer bonded between the first interposer and the substrate.

The at least one plastic body can include a liquid crystal polymer (LCP). The insert can include a nickel-iron alloy. The nickel-iron alloy can be FENi36 or FENi42. The at least one plastic part and the at least one silicon part can be bonded together with an adhesive. The adhesive can be an epoxy. The fluid ejector can further include a non-wetting coating attached to a side of the fluid ejection assembly having the nozzles. The non-wetting coating can include tridecafluoro-1,1,2,2-tetrahydrooctyltrichlorosilane (FOTS) or 1H,1H,2H,2H-perfluorodecyltrichlorosilane (FDTS).

A length and width of the insert can be approximately equivalent to a length and width of the at least one silicon body. A plane along the length and width of the insert can be approximately parallel to a plane along the length and width of the at least one silicon body.

The at least one plastic body can have a CTE of between about 10 and 50 ppm/° C. The at least one plastic body can be molded around the insert. The plastic can be injection molded. The at least one plastic body can have a plurality of CTEs, including a first CTE measured in a direction of plastic injection and a second CTE measured in a direction traverse to the direction of plastic injection. The first CTE can be about 5 to 15 ppm/° C., such as approximately 10 ppm/° C., and the second CTE can be approximately 20-50 ppm/° C., such as approximately 40 ppm/° C.

In general, in one aspect, a method of making a fluid ejector includes molding a plastic body around an insert so as to embed the insert in the plastic body and sealingly attaching the plastic body to a silicon body. The insert has a coefficient of thermal expansion (CTE) of less than 9 ppm/° C. The silicon body part of a fluid ejection assembly has one or more silicon bodies including a silicon body having a plurality of fluid passages for fluid flow and a plurality of nozzles fluidically connected to the plurality of fluid passages. Attaching forms a sealed volume on a side of the fluid ejection assembly opposite the nozzles This and other embodiments can optionally include one or more of the following features. The insert can include a nickel-iron alloy. Molding the plastic body can include injection molding. The method can further include stamping the insert from a sheet of nickel-iron alloy before molding the plastic body.

Sealingly attaching the plastic body to the silicon can include attaching with an adhesive. The method can further include heating the plastic body and the silicon body to a temperature of between 120 and 160° C. to attach the plastic body and the silicon body with the adhesive.

The method can further include attaching a non-wetting coating to a side of the fluid ejection assembly having the nozzles. Attaching the non-wetting coating can include heating the fluid ejection assembly and the non-wetting coating to between 25° C. and 100° C., such as 35° C.

Certain implementations may have one or more of the following advantages. Embedding a nickel-iron alloy insert having a CTE of less than 9 ppm/° C., such as FeNi36 or FeNi42, can reduce the effective CTE of a plastic body in the housing, e.g. can limit the expansion of the plastic body when heated. Such a reduction of the effective CTE can allow the effective CTE of the housing to more closely match of the CTE of the one or more silicon bodies, thereby reducing damage caused by heating the fluid ejector, such as stress at the bond between the housing and fluid ejection assembly and distortion of the fluid ejector.

The details of one or more embodiments are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

During fluid droplet ejection, droplet placement on the print media can be inaccurate due to distortion of the fluid ejector caused by having materials in the fluid ejector, e.g. a silicon body and a plastic die cap, with different coefficients of thermal expansion (CTEs). That is, if the fluid ejector is heated, e.g. during processing, the silicon body and plastic die cap will expand at different rates, causing stress at the bond and warping of the fluid ejector. By including an insert having a low CTE in the plastic die cap, the coefficient of thermal expansion of the die cap can more closely match that of silicon, thereby reducing the distortion of the fluid ejector and improving the accuracy of droplet placement.

Figure 1:
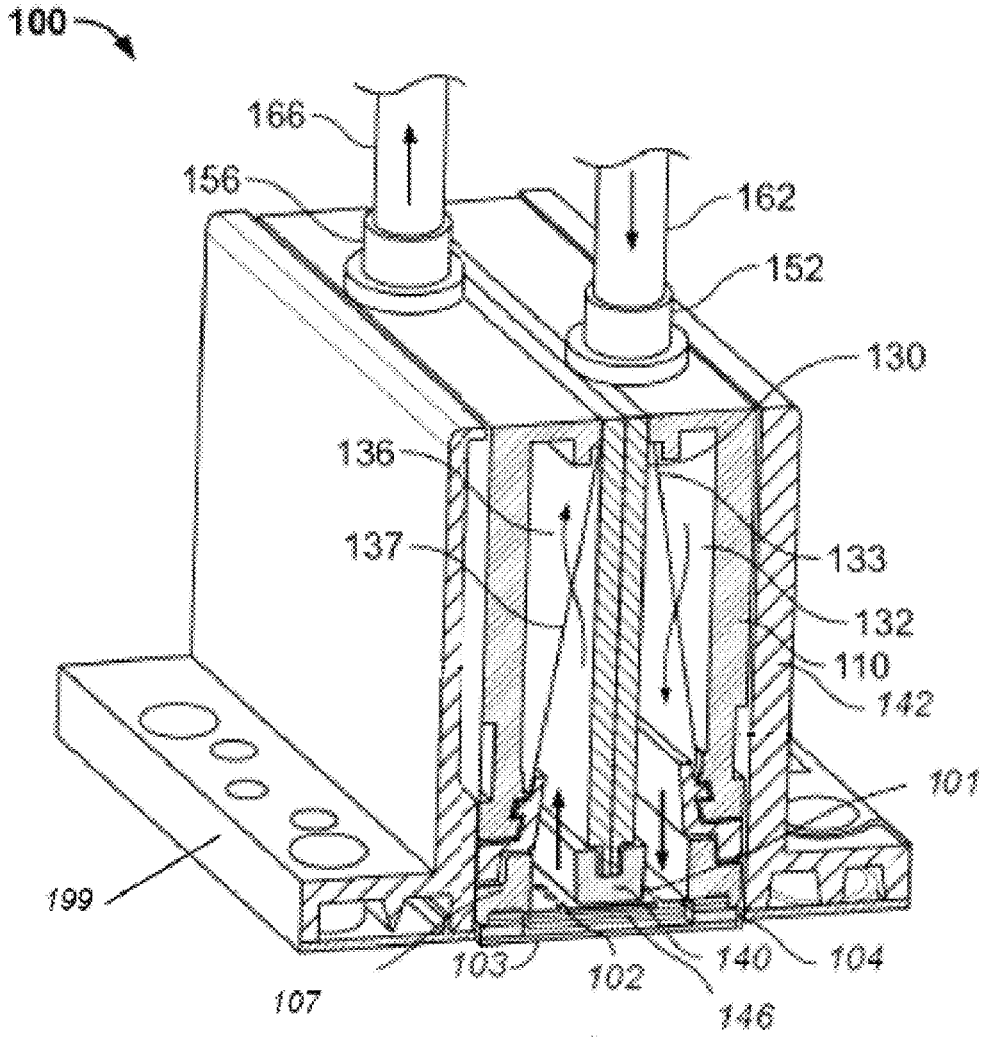
FIG. 1 shows an exemplary fluid ejection module.

Referring to FIG. 1, an implementation of a fluid ejector 100 includes a fluid ejection module, e.g. a quadrilateral plate-shaped printhead module, which can be a die fabricated using semiconductor processing techniques. The fluid ejection module includes a substrate 103, which can be made of a semiconductor material, e.g. single crystal silicon. The substrate 103 can include a plurality of fluid flow paths 124 (see FIG. 2), which can be formed by semiconductor processing techniques, e.g. etching. The substrate 103 can further include a plurality of actuators 401 (see FIG. 2) to individually control ejection of fluid from nozzles of the fluid flow paths.

The fluid ejector 100 can also include an inner housing 110 and an outer housing 142 to support the fluid ejection module, a mounting frame 199 to connect the inner housing 110 and outer housing 142 to a support structure of a fluid ejection system (e.g., a system having multiple aligned fluid ejection modules), and a flexible circuit, or flex circuit, 201 (see FIG. 2) to receive data from an external processor and provide drive signals to the die.

The inner housing 110 can include a die cap 107 configured to provide a bonding area for components of the fluid ejector that are used in conjunction with the substrate 103. The die cap 107 can include an insert 422 (see FIG. 2), as discussed further herein. Further, the inner housing 110 can be divided by a dividing wall 130 to provide an inlet chamber 132 and an outlet chamber 136. Each chamber 132 and 136 can include a filter 133 and 137. Tubing 162 and 166 that carries the fluid can be connected to the chambers 132 and 136, respectively, through apertures 152, 156. As shown in FIG. 1, the fluid ejector 100 includes fluid inlets 101 and fluid outlets 102 for allowing fluid to circulate from the inlet chamber 132, through the substrate 103, and into the outlet chamber 136.

Figure 2:
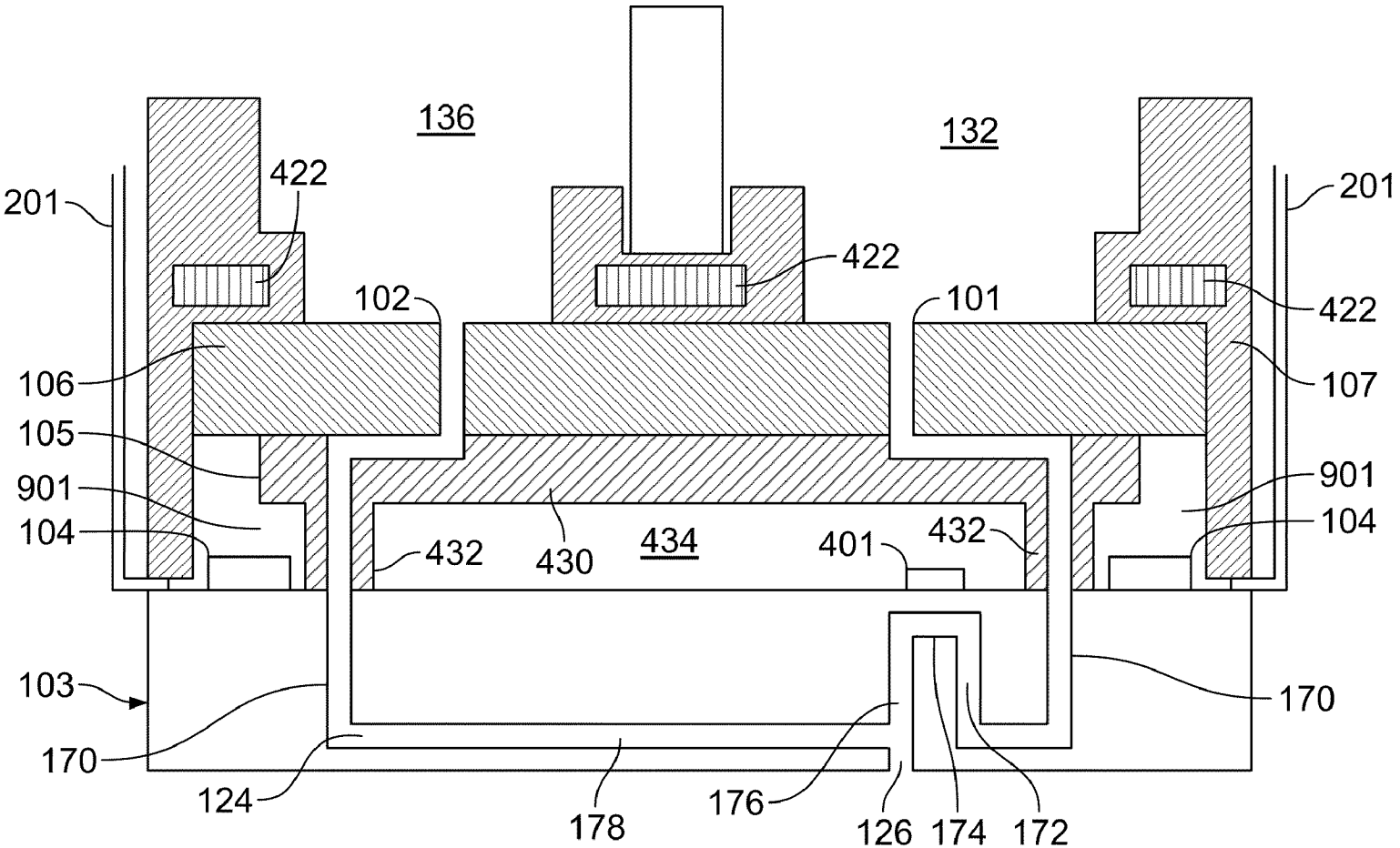
FIG. 2 is a cross-section of an exemplary fluid ejection module showing the fluid passages.

Referring to FIG. 2, the substrate 103 can include fluid flow paths 124 that end in nozzles 126 (only one flow path is shown in FIG. 2). A single fluid path 124 includes a fluid feed 170, an ascender 172, a pumping chamber 174, and a descender 176 that ends in the nozzle 126. The fluid path can further include a recirculation path 178 so that ink can flow through the ink flow path 124 even when fluid is not being ejected.

The fluid ejector 100 can also include individually controllable actuators 401 supported on the substrate 103 for causing fluid to be selectively ejected from the nozzles 126 of corresponding fluid paths 124 (only one actuator 401 is shown in FIG. 2). In some embodiments, activation of the actuator 401 causes a membrane over the pumping chamber 174 to deflect into the pumping chamber 174, forcing fluid through the descender 176 and out of the nozzle 126. For example, the actuator 401 can be a piezoelectric actuator. Alternatively, the actuator 401 can be a thermal actuator. Each flow path 124 with its associated actuator 401 provides an individually controllable MEMS fluid ejector unit. Although not shown, the nozzles can be formed in a nozzle plate. A non-wetting coating, e.g. a self-assembled monolayer including a single molecular layer, can cover the nozzle plate. Suitable precursors for the non-wetting coating can include tridecafluoro-1,1,2,2-tetrahydrooctyltrichlorosilane (FOTS) and 1H,1H,2H,2H-perfluorodecyltrichlorosilane (FDTS).

The fluid ejector 100 further includes one or more integrated circuit elements 104 configured to provide electrical signals to control the actuators 401. Each of the integrated circuit elements 104 can be a microchip, other than the substrate 103, in which integrated circuits are formed, e.g., by semiconductor fabrication and packaging techniques. For example, the integrated circuit elements 104 can be application-specific integrated circuit (ASIC) elements. The integrated circuit elements 104 can be mounted directly onto the substrate 103 in a row extending parallel to the inlets 101 or outlets 102.

In some embodiments, the fluid ejector 100 includes a lower interposer 105 to separate the fluid from electrical components of actuators 401 and/or the integrated circuit elements 104. As shown in FIG. 2, the lower interposer 105 can include a main body 430 and flanges 432 that project down from the main body 430 to contact the substrate 103 in a region between the integrated circuit elements 104 and the actuators 401. The flanges 432 hold the main body 430 over the substrate to form an actuator cavity 434. This prevents the main body 430 from contacting and interfering with motion of the actuators 401. The fluid ejector 100 can further include an upper interposer 106 to further separate the fluid from the actuators 401 or integrated circuit elements 104.

In some embodiments, the lower interposer 105 directly contacts, with or without a bonding layer therebetween, the substrate 103, and the upper interposer 106 directly contacts, with or without a bonding layer therebetween, the lower interposer 105. Thus, the lower interposer 105 is sandwiched between the substrate 103 and the upper interposer 106, while maintaining the cavity 434.

The upper interposer 106, the lower interposer 105, and the substrate 103 can be part of a fluid ejection assembly. Although the fluid ejection assembly is described herein as including the upper interposer 106, the lower interposer 105, and the substrate 103, not all components need to be included. For example, the fluid ejection assembly might only include the substrate 103 (in which case the die cap could be bonded to the substrate 103). Alternatively, the fluid ejection assembly might only include the substrate 103 and the lower interposer 105 (in which case the die cap could be bonded to the lower interposer). The bodies of the fluid ejection assembly (e.g. the substrate 103, lower interposer 105, and/or upper interposer 106) can be formed of the same material, e.g., silicon, and thus have the same CTE. The bodies of the fluid ejection assembly can each have a CTE of approximately 2-3 ppm/° C.

Figure 3A:
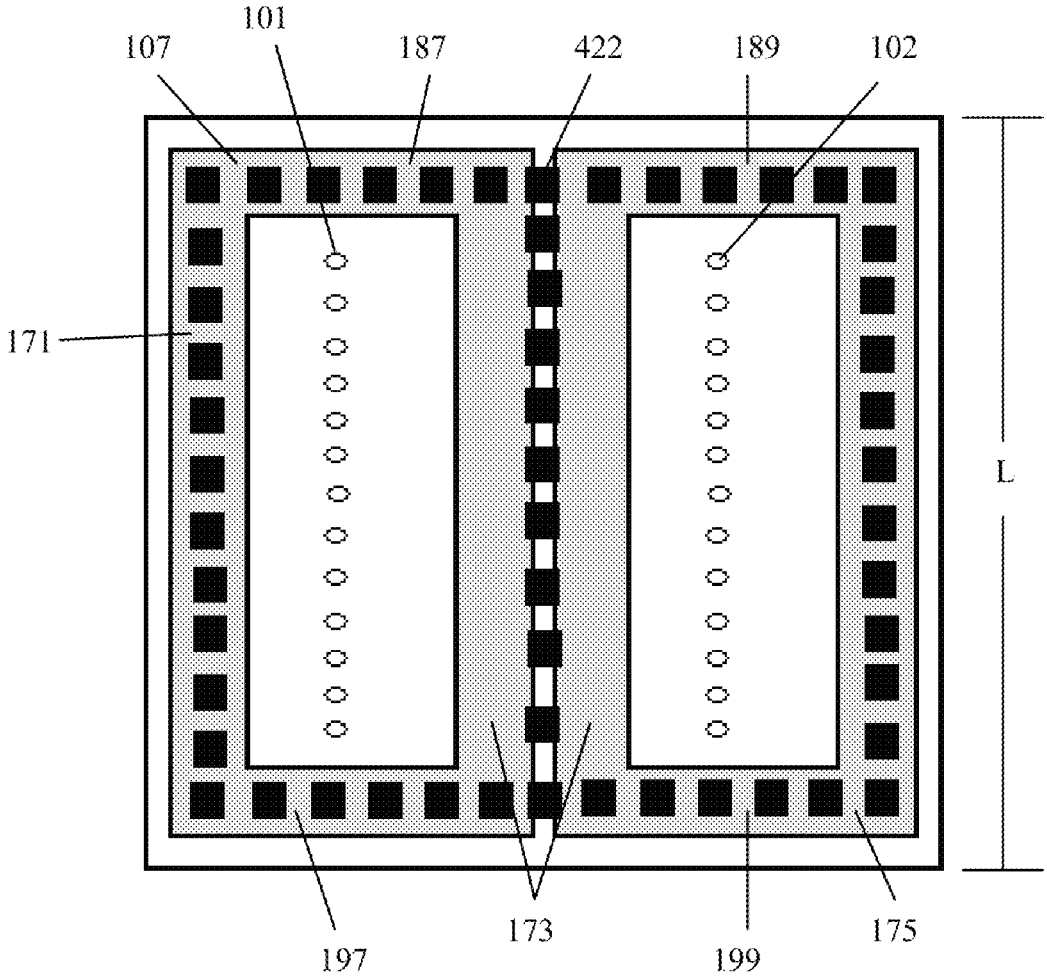
FIG. 3A is a schematic of a top view of an exemplary fluid ejection module having an insert in the die cap.
Figure 3B:
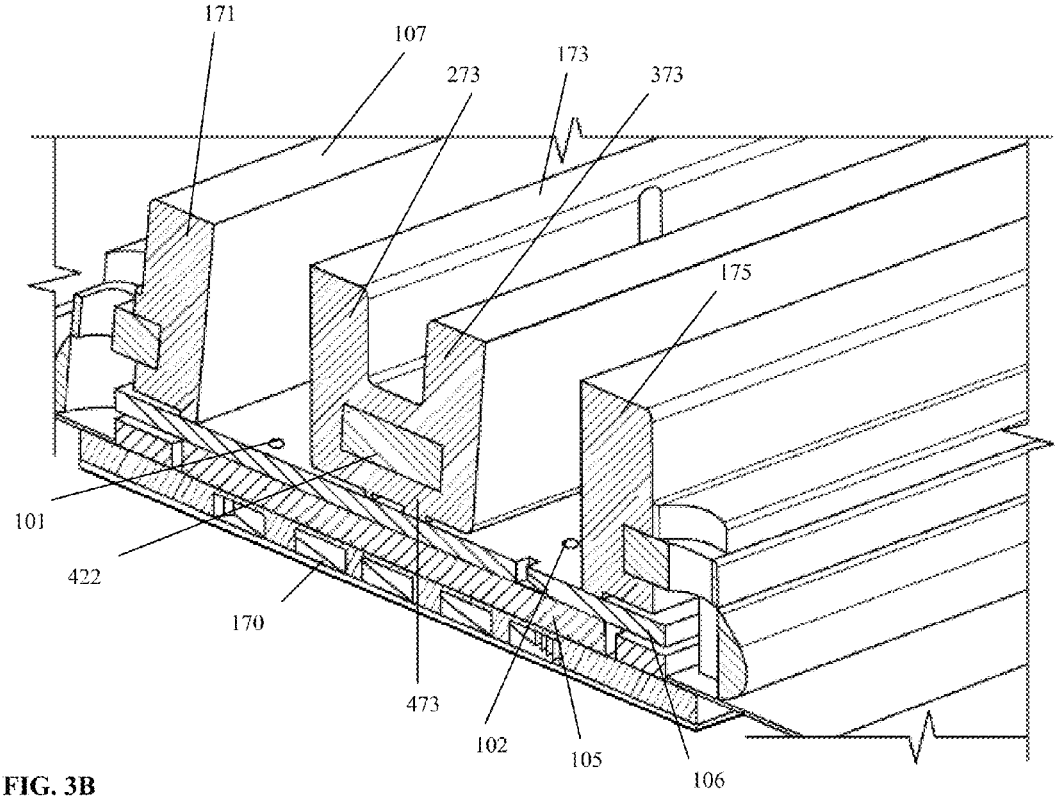
FIG. 3B is a close-up cross-sectional perspective view of an exemplary fluid ejection module having an insert in the die cap

Referring to FIGS. 3A and 3B, the fluid ejector 100 can include a die cap 107. The die cap 107 can be formed of a plastic, for example, liquid crystal polymer (LCP). The die cap 107 can be bonded to the fluid ejection assembly. For example, as shown in FIG. 3A, the die cap 107 can be bonded to the upper interposer 106. The die cap 107 and fluid ejection assembly can be bonded together with, for example, epoxy. Further, as shown in FIG. 2, the die cap 107 can be bonded to a portion of the flex circuit 201 that is bonded to the substrate 103, creating a cavity 901. Although not shown, the cavity 434 with the actuators can be connected to the cavity 901 with the ASICs 104. For example, flanges 432 can extend only around fluid feed channels 170, e.g. in a donut shape, such that cavities 434 and 901 form one cavity, and air can pass between adjacent flanges. The flex circuit 201 can bend around the bottom of the die cap 107 and extend along an exterior of the die cap 107.

The die cap 107 can include multiple, e.g., three, members 171, 173, and 175. The members 171, 173, 175 can extend in parallel, and be connected by crossbars 187, 189 at one end of the die cap 107 and crossbars 197, 199 at the opposite end of the die cap 107. The members 171, 173, and 175 can be positioned on the fluid ejection assembly so as not to interfere with the fluid inlets 101 and fluid outlets 102 to allow fluid to flow through the fluid ejection module 100. For example, two members 171 and 175 can be positioned near the edges of the fluid ejection assembly on the outside of fluid inlets 101 and fluid outlets 102. One member 173 can be positioned in the center of the fluid ejection assembly, e.g. between the fluid inlets 101 and fluid outlets 102. As shown in FIG. 3B, member 173 can include two vertical portions 273, 373 that are connected near the interposers 105, 106 with a horizontal portion 473. The fluid inlets 101 and fluid outlets 102 can be arranged in a line parallel to the length of the members 171, 173, and 175. Further, the die cap 107 can include an opening in which an insert 422 is embedded, as described further herein. The opening can run along the inside of each member 171, 173, 175, and through each crossbar.

The die cap 107 can be formed by molding, e.g. injection molding. As a result of the injection molding and shape of the die cap 107, the die cap can have varying CTEs. For example, the die cap 107 can have one CTE in the direction that the plastic is injected into the mold and one CTE in the traverse direction. For example, the CTE in the direction of injection can between 5 and 15 ppm/° C., e.g. about 10 ppm/° C. In contrast, the CTE in the direction traverse to the direction of injection can be up to ten times greater, such as between 20-50 ppm/° C., e.g. about 40 ppm/° C.

The die cap 107 can include an insert 422. The insert 422 can be formed of a material having a CTE of less than 9 ppm/° C., such as 1-2 ppm/° C. For example, the insert 422 can comprise a nickel steel alloy or a nickel iron alloy, such as Invar® (FeNi36), FeNi42, or FeNiCo. Alternatively, the insert 422 can be composed of a ceramic, silicon, glass, silicon carbide, or thermoset plastic, such as Kyocera KE-4700. The insert 422 can be embedded in the die cap 107 such the insert fills the entire opening of the die cap 107, e.g. such that that all sides of the insert 422 are encompassed by the die cap 107. For example, the die cap 107 can be molded, e.g. injection molded, around the insert 422.

Figure 4:
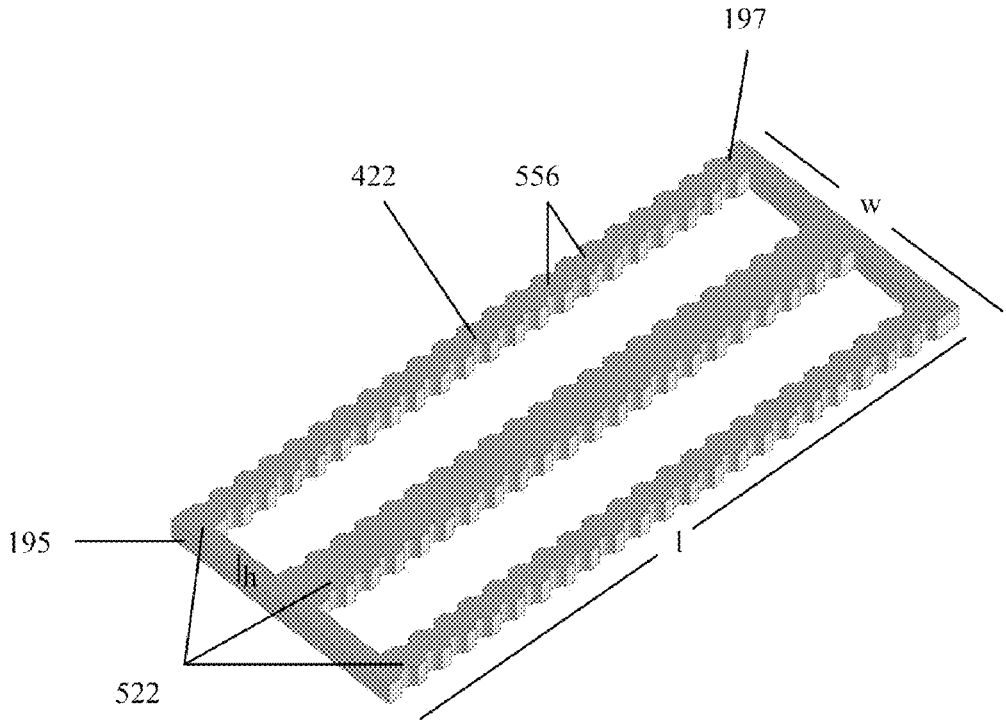
FIG. 4 is a perspective view of an exemplary insert.

As shown in FIG. 4, the insert 422 can have a length l, a width w, and a height h. The length l and width w can each be greater than the height h. A plane along the width and length of the insert 422 can be parallel to a length and a width of the fluid ejection assembly. The insert 422 can further include three members 522, which can be parallel to one another and parallel to a length L of the fluid ejector (see FIG. 3A), where the length L is the longest dimension of the fluid ejector. Each of the members 522 can be embedded, e.g. completely enclosed, in an associated member 171, 173, 175 of the die cap 107. Further, the edges along the length l of members 522 can have protrusions 556 configured to interlock with the die cap to prevent the insert from slipping or moving, e.g. during thermal expansion. The protrusions can be perpendicular to the length l of the members 522. The insert can further include crossbars 195, 197 connecting the members 171, 173, 175 at opposite ends. The crossbars 195, 197 can be embedded, e.g. completely enclosed, in the crossbars of the die cap 107. The insert 422 can take up about 40% of the die cap by volume. The insert 422 can be formed, for example, by stamping.

During production of the fluid ejection module, various stages of heating can be required. For example, when the die cap is bonded to the fluid ejection assembly, heating of the fluid ejection module to about 120° C. or greater, for example between 120° C. and 160° C., is required. Likewise, in order to apply a non-wetting coating to the nozzles, the fluid ejection module may have to be heated to between 25° C. and 100° C., for example 35° C. These heating steps can cause the plastic die cap and the silicon fluid ejection assembly to expand and shrink at different rates. For example, if the plastic die cap is heated from, for example 25° C., to, for example, 125° C., the die cap can grow about 40 microns in the traverse direction. In contrast, the silicon fluid ejection assembly may only grow about 11 microns.

The different growths and corresponding shrinkages when the temperature is reduced can cause several problems during fluid ejection. For example, heating prior to and during the bonding of the die cap and fluid ejection assembly can cause the bowing of the fluid ejection assembly as the plastic subsequently decreases in size more than the silicon fluid assembly. Such bowing can make the alignment of fluid ejection modules in a system inaccurate. Further, the bowing can cause differing flight times for droplets ejected from nozzles of the same fluid ejection module, causing inaccuracies in the resulting droplet placement on the print medium and difficulties in performing maintenance of the fluid ejection module. Likewise, heating after bonding of the die cap and fluid ejection assembly can create stress at the bond of the die cap and fluid ejection assembly and ultimately cause the fluid ejection assembly and die cap to become separated. Such a break in the bond can cause leaking of fluid and inaccuracies in the fluid ejection process.

By embedding an insert having a CTE of less than 9 ppm/° C. in the die cap, the effective CTE of the die cap can be reduced to more closely match the CTE of the silicon fluid ejection assembly. That is, the inherent strength of the materials used for the insert (e.g. the young's modulus of FeNi36 or FeNi42 can be up to 30 million PSI), can dominate that of the plastic die cap (the young's modulus of plastic is approximately 1-2 million PSI), forcing the plastic die cap to essentially adopt the CTE of the insert. The insert can thus restrain the expansion and contraction of the die cap during heating. The relative expansion and contraction of the plastic die cap and the silicon fluid ejection assembly can thus be controlled to be equivalent within a few microns.

Particular embodiments have been described. Other embodiments are within the scope of the following claims.

What is claimed is:

1. A fluid ejector comprising:

a fluid ejection assembly comprising:

one or more silicon bodies including a silicon body having a plurality of fluid passages for fluid flow and a plurality of nozzles fluidically connected to the plurality of fluid passages; and a plurality of actuators to cause fluid in the plurality of fluid passages to be ejected from the plurality of nozzles;

a housing assembly having one or more plastic bodies, at least one plastic body of the one or more plastic bodies sealingly attached to at least one silicon body of the one or more silicon bodies to form a sealed volume on a side of the fluid ejection assembly opposite the nozzles; and an insert embedded in the at least one plastic body in proximity to the at least one silicon body, the insert being embedded such that all sides of the insert are covered by the plastic body, the insert having a coefficient of thermal expansion (CTE) of less than 9 ppm/° C.

2. The fluid ejector of claim 1, wherein the silicon body having the plurality of fluid passages for fluid flow and the plurality of nozzles fluidically connected to the plurality of fluid passages comprises a substrate, and wherein the at least one silicon body comprises an interposer.

3. The fluid ejector of claim 2, wherein the interposer is a first interposer, and wherein the fluid ejection assembly further comprises a second interposer bonded between the first interposer and the substrate.

4. The fluid ejector of claim 1, wherein the at least one plastic body comprises liquid crystal polymer (LCP).

5. The fluid ejector of claim 1, wherein the at least one plastic body and the at least one silicon body are bonded together with an adhesive.

6. The fluid ejector of claim 5, wherein the adhesive is epoxy.

7. The fluid ejector of claim 1, further comprising a non-wetting coating attached to a side of the fluid ejection assembly having the nozzles.

8. The fluid ejector of claim 7, wherein the non-wetting coating comprises tridecafluoro-1,1,2,2-tetrahydrooctyltrichlorosilane (FOTS) or 1H,1H,2H,2H-perfluorodecyltrichlorosilane (FDTS).

9. The fluid ejector of claim 1, wherein a length and width of the insert is approximately equivalent to a length and width of the at least one silicon body.

10. The fluid ejector of claim 9, wherein a plane along the length and width of the insert is approximately parallel to a plane along the length and width of the at least one silicon body.

11. The fluid ejector of claim 1, wherein the at least one plastic body has a CTE of between about 10 and 50 ppm/° C.

12. The fluid ejector of claim 1, wherein the at least one plastic body is molded around the insert.

13. The fluid ejector of claim 12, wherein the at least one plastic body is injection molded.

14. The fluid ejector of claim 13, wherein the at least one plastic body has a plurality of CTEs, including a first CTE measured in a direction of plastic injection and a different second CTE measured in a direction traverse to the direction of plastic injection.

15. The fluid ejector of claim 14, wherein the first CTE is about 5 to 15 ppm/° C., and wherein the second CTE is approximately 20-50 ppm/° C.

16. The fluid ejector of claim 15, wherein the first CTE is approximately 10 ppm/° C., and wherein the second CTE is approximately 40 ppm/° C.

17. A fluid ejector comprising:

a fluid ejection assembly comprising:

one or more silicon bodies including a silicon body having a plurality of fluid passages for fluid flow and a plurality of nozzles fluidically connected to the plurality of fluid passages; and a plurality of actuators to cause fluid in the plurality of fluid passages to be ejected from the plurality of nozzles;

a housing assembly having one or more plastic bodies, at least one plastic body of the one or more plastic bodies sealingly attached to at least one silicon body of the one or more silicon bodies to form a sealed volume on a side of the fluid ejection assembly opposite the nozzles; and an insert embedded in the at least one plastic body in proximity to the at least one silicon body, the insert having a coefficient of thermal expansion (CTE) of less than 9 ppm/° C., wherein the insert comprises a nickel-iron alloy.

18. The fluid ejector of claim 17, wherein the nickel-iron alloy is FeNi36.

19. The fluid ejector of claim 17, wherein the nickel-iron alloy is FeNi42.

20. A method of making a fluid ejector comprising:

molding a plastic body around an insert so as to embed the insert in the plastic body such that all sides of the insert are covered by the plastic body, the insert having a coefficient of thermal expansion (CTE) of less than 9 ppm/° C.;

sealingly attaching the plastic body to a silicon body, the silicon body part of a fluid ejection assembly having one or more silicon bodies including a silicon body having a plurality of fluid passages for fluid flow and a plurality of nozzles fluidically connected to the plurality of fluid passages, wherein the attaching forms a sealed volume on a side of the fluid ejection assembly opposite the nozzles.

21. The method of claim 20, wherein molding the plastic body comprises injection molding.

22. The method of claim 20, further comprising stamping the insert from a sheet of nickel-iron alloy before molding the plastic body.

23. The method of claim 20, wherein sealingly attaching the plastic body to the silicon body comprises attaching with an adhesive.

24. The method of claim 23, further comprising heating the plastic body and the silicon body to a temperature of between 120° C. and 160° C. to attach the plastic body and the silicon body with the adhesive.

25. The method of claim 20, further comprising attaching a non-wetting coating to a side of the fluid ejection assembly having the nozzles.

26. The method of claim 25, wherein attaching the non-wetting coating comprises heating the fluid ejection assembly and the non-wetting coating to a temperature of between 25° C. and 100° C.

27. The method of claim 26, wherein the temperature is approximately 35° C.

28. A method of making a fluid ejector comprising:

molding a plastic body around an insert so as to embed the insert in the plastic body, the insert having a coefficient of thermal expansion (CTE) of less than 9 ppm/° C., wherein the insert comprises a nickel-iron alloy;

sealingly attaching the plastic body to a silicon body, the silicon body part of a fluid ejection assembly having one or more silicon bodies including a silicon body having a plurality of fluid passages for fluid flow and a plurality of nozzles fluidically connected to the plurality of fluid passages, wherein the attaching forms a sealed volume on a side of the fluid ejection assembly opposite the nozzles.

* * * * *